US008702030B1

(12) United States Patent
Gilham, Jr.

(10) Patent No.: US 8,702,030 B1
(45) Date of Patent: Apr. 22, 2014

(54) ABOVE-GROUND POOL WALL INSTALLATION APPARATUS AND METHOD

(76) Inventor: William A. Gilham, Jr., Columbus, IN (US)

( * ) Notice: Subject to any disclaimer, the term of this patent is extended or adjusted under 35 U.S.C. 154(b) by 745 days.

(21) Appl. No.: 12/943,727

(22) Filed: Nov. 10, 2010

(51) Int. Cl.
*B65H 75/18* (2006.01)

(52) U.S. Cl.
USPC ..... 242/597.7; 242/588; 242/405; 242/406

(58) Field of Classification Search
USPC ..... 242/597, 597.7, 400, 405, 405.3, 407, 242/588, 588.3, 588.6, 406
See application file for complete search history.

(56) References Cited

U.S. PATENT DOCUMENTS

| | | | | | |
|---|---|---|---|---|---|
| 1,128,649 | A | * | 2/1915 | Adams | 400/615 |
| 1,262,446 | A | * | 4/1918 | Caron | 242/577.4 |
| 2,096,168 | A | * | 10/1937 | Ferber | 242/597.7 |
| 2,510,292 | A | * | 6/1950 | Pierce, Jr. | 57/130 |
| 3,539,124 | A | * | 11/1970 | Belokin, Jr. | 242/597.7 |
| 3,625,449 | A | * | 12/1971 | Landsem | 242/597.7 |
| 3,952,962 | A | * | 4/1976 | Kidd | 242/597.7 |
| 4,465,246 | A | * | 8/1984 | Kosch | 242/156.2 |
| 4,681,277 | A | * | 7/1987 | Kosch | 242/156.2 |
| 4,953,810 | A | * | 9/1990 | Stadig | 242/423.1 |
| 6,042,046 | A | | 3/2000 | Beyer, Sr. | |
| 6,422,504 | B1 | | 7/2002 | Elder | |
| 6,536,702 | B1 | | 3/2003 | Vargo et al. | |
| 6,702,226 | B1 | * | 3/2004 | Bowling | 242/597.4 |
| 6,860,471 | B2 | | 3/2005 | Albritton | |
| 7,278,604 | B1 | | 10/2007 | Constantino | |
| 2003/0080236 | A1 | | 5/2003 | Armstrong | |
| 2007/0095026 | A1 | | 5/2007 | Moser et al. | |

* cited by examiner

*Primary Examiner* — William A Rivera
(74) *Attorney, Agent, or Firm* — Montgomery Patent & Design; Robert C. Montgomery

(57) ABSTRACT

An above-ground pool wall installation apparatus comprises a base and a turntable. The base, made of a resilient material comprises a spherical platform which supports the turntable. A bifurcated rope provided with a handle allows a user to manually pull the apparatus along a pre-determined perimeter, thereby creating the wall of the pool by progressively dispensing the material from a coil mounted onto the rotating turntable.

11 Claims, 3 Drawing Sheets

ABOVE-GROUND POOL WALL INSTALLATION APPARATUS AND METHOD

RELATED APPLICATIONS

The present invention was first described in a notarized Official Record of Invention on Dec. 15, 2009, that is on file at the offices of Montgomery Patent and Design, LLC, the entire disclosures of which are incorporated herein by reference.

FIELD OF THE INVENTION

The present invention relates generally to above-ground swimming pools, and in particular, to an apparatus and method for installing the wall for an above-ground pool.

BACKGROUND OF THE INVENTION

The nature of above-ground pool installation differs drastically from the laying of an in-ground pool. In particular, the deployment and placement of the pool sidewall is a tedious and difficult task which generally requires many hands.

Above-ground pool walls are conventionally delivered in a rolled up, coiled state. Since they are difficult to un-roll in the exact location needed, many installation teams simply unroll the coil for its entire length and then manhandle the wall into place. This obviously requires a large number of workers. Additionally, the thin nature of the pool wall also makes it vulnerable to dents and other damage.

Various attempts have been made to provide tools for handling rolled materials. Examples of these attempts can be seen by reference to several U.S. patents. U.S. Pat. No. 6,042,046, issued in the name of Beyer, Sr., describes a reeling and unreeling apparatus for spools of material which is attachable to a vehicle hitch.

U.S. Pat. No. 6,422,504, issued in the name of Elder, describes a wire spool cart which provides rolling transportation for a plurality of spools.

U.S. Pat. No. 6,860,471, issued in the name of Albritton, describes a fence dispensing apparatus for installing fence wire along a line of fence posts.

While these devices fulfill their respective, particular objectives, each of these references suffer from one (1) or more of the aforementioned disadvantages. Many such devices are not well adapted to sheet materials. Also, many such devices are not adapted for use along a non-paved surface. Furthermore, many such devices are not simple in construction and operation which contributes to increased time and expense to build and operate them. In addition, many such devices are not well adapted for use in installing above-ground pools. Accordingly, there exists a need for an above-ground pool wall installation apparatus without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for an apparatus which allows a small number of operators to quickly and accurately install an above-ground pool wall from an initially rolled configuration in a manner which is simple and cost effective. Thus, the object of the present invention is to solve the aforementioned disadvantages and provide for this need.

To achieve the above objectives, it is an object of the present invention to comprise an apparatus and method for installing the wall for an above-ground pool. The apparatus comprises a base, a platform, a platform supporting filler, and a turntable.

Another object of the present invention is to comprise the base of a durable semispherical bottom surface which facilitates sliding across an unpaved ground surface.

Yet still another object of the present invention is to receive and retain a coil of pool wall material. The turntable comprises a tubular center post and a hub located at the top of the post which respectively receive and stabilize the coil. The turntable is rotatably removably connected to the base of the apparatus by fitting over a centrally-located upwardly extending axle structure integrally attached to the base.

Yet still another object of the present invention is to allow the pool wall material to uncoil freely when pulled without necessitating rotation of the base. The apparatus further comprises a bearing which comprises a plurality of stacked flat disks constructed of a low friction material. The bearing reduces friction between the turntable and base portions of the apparatus.

Yet still another object of the present invention is to facilitate transportation of the apparatus when loaded with a coil of pool wall material via a handle attached to the base.

Yet still another object of the present invention is to provide a method of utilizing the device that provides a unique means of obtaining an instance of the apparatus, assembling the apparatus, placing a coil of pool wall material over the tubular center post and hub, transporting the apparatus to a location of an above ground pool installation, utilizing the handle to position the apparatus in place about a starting location of the pool wall perimeter, fastening a loose edge of the coiled material to a wall upright, uncoiling the material progressively by continuously pulling the apparatus along the predetermined perimeter of the pool, fastening the material to previously installed wall uprights as necessary, and closing the pool wall loop by completely circling the predetermined pool perimeter and fastening the remaining tail end of the coil material onto the last wall upright and the starter portion.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
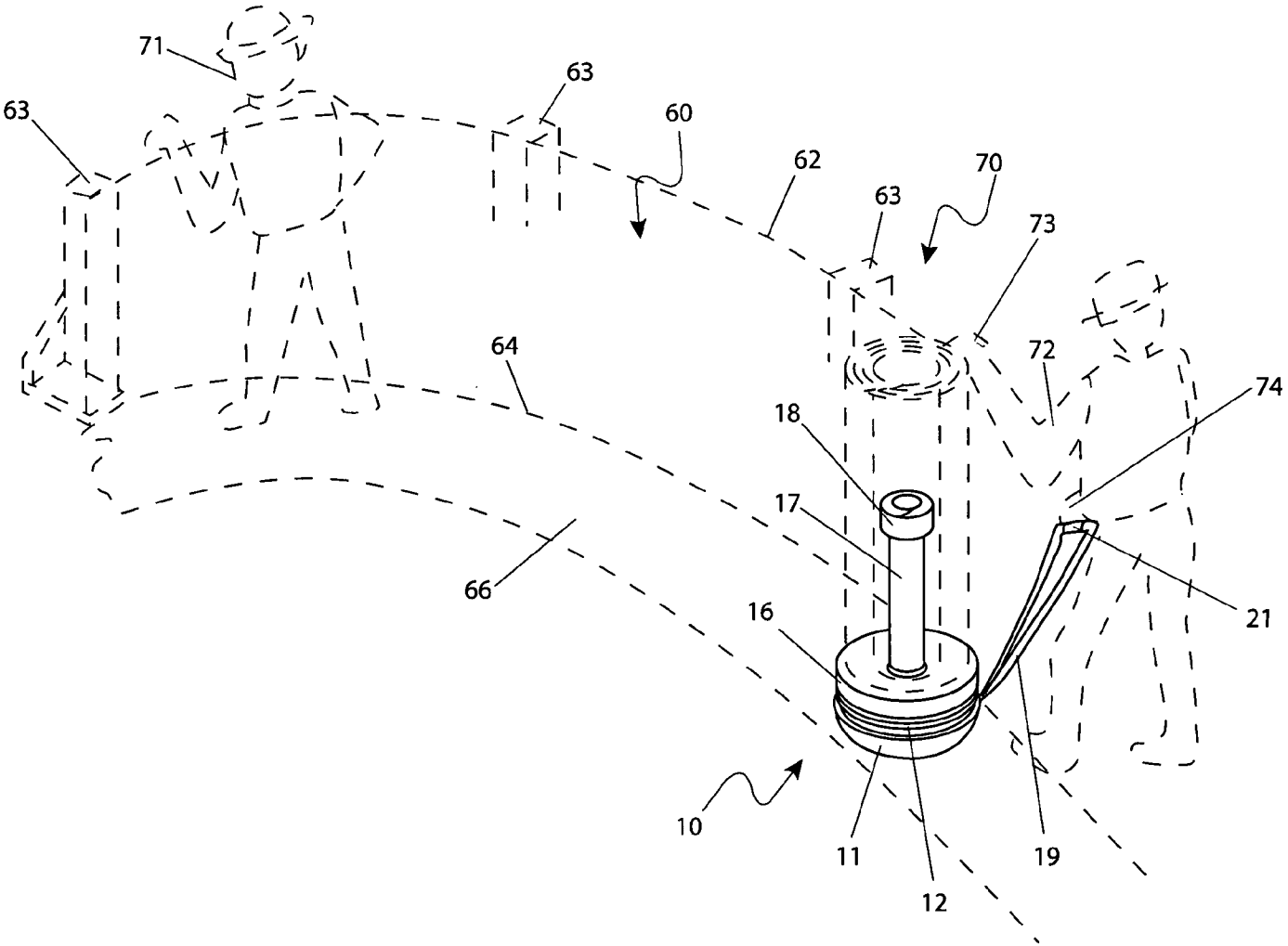
FIG. 1 is an environmental perspective view of an above-ground pool wall installation apparatus 10 depicted in progressive use, according to a preferred embodiment of the present invention.

10 above-ground pool wall installation apparatus
11 base
12 bearing

13 filler
14 platform
15*a* first center aperture
15*b* second center aperture
15*c* third center aperture
16 turntable
17 center post
18 hub
19 bi-furcated rope
21 handle
22 axle
23 platform ear
24 slot
60 pool wall
61 coiled material
62 partially deployed portion
63 wall upright
64 wall channel
66 ground
71 first user
72 second user
73 first hand
74 second hand

DETAILED DESCRIPTION OF THE PREFERRED EMBODIMENT

Figure 2A:
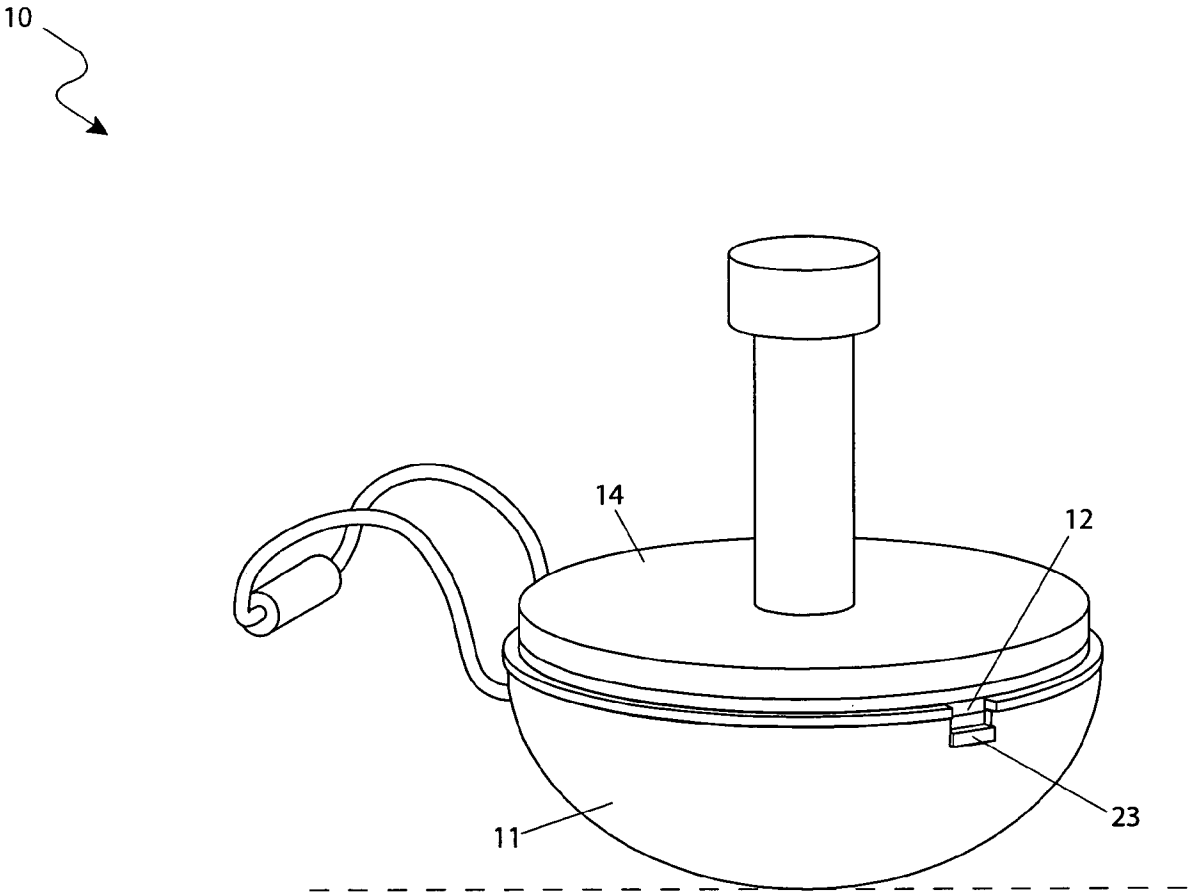
FIG. 2*a* is a perspective assembled view of the above-ground pool wall installation apparatus 10, according to the preferred embodiment of the present invention; and, FIG. 2*b* is a perspective exploded view of the above-ground pool wall installation apparatus 10, according to the preferred embodiment of the present invention.
Figure 2B:
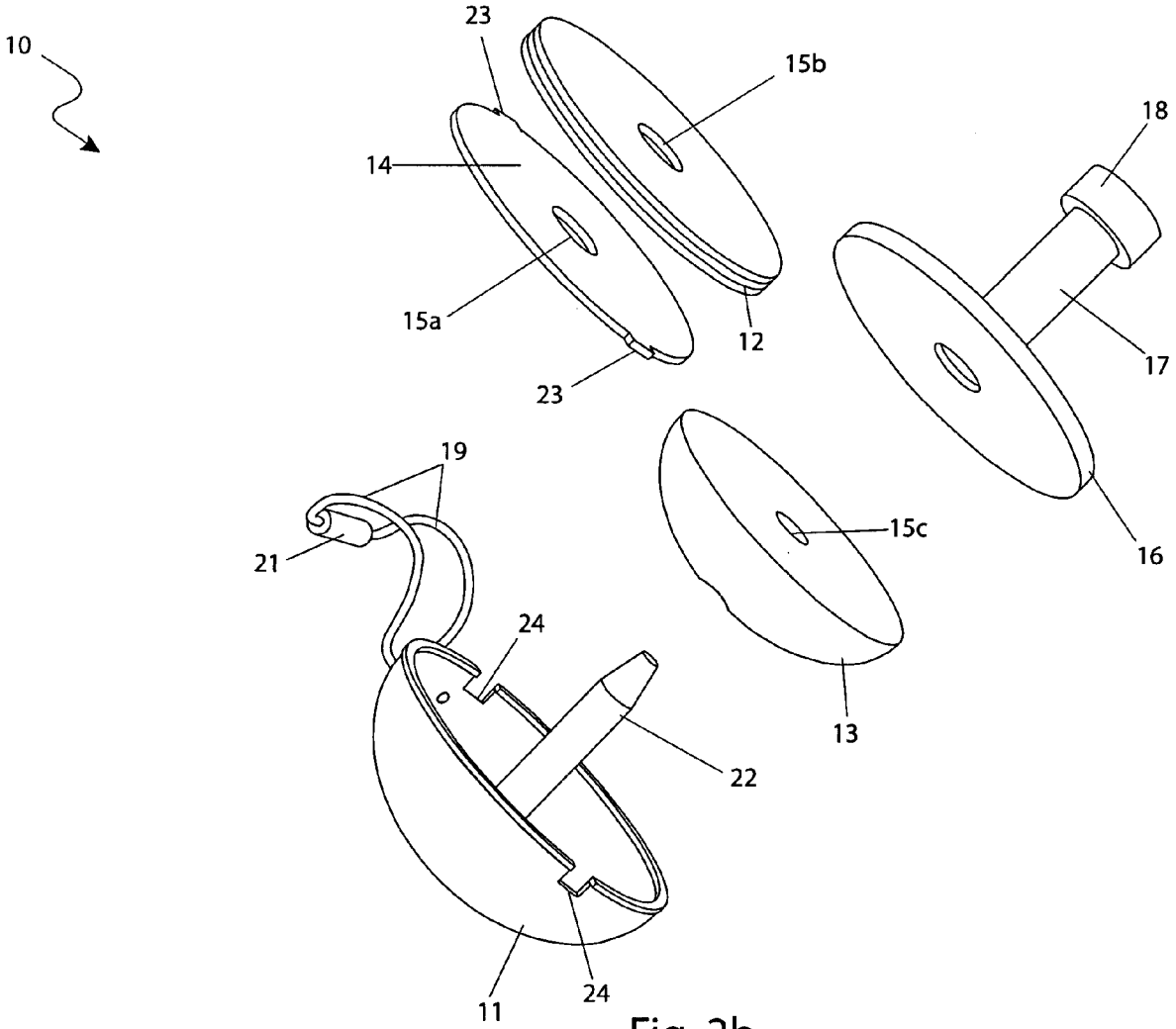

The best mode for carrying out the invention is presented in terms of its preferred embodiment, herein depicted within FIGS. 1 through 2*b*. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an apparatus (herein described as "the apparatus 10") and a method for installing the wall 60 for an above-ground pool.

Referring now to FIG. 1, an environmental perspective view of the apparatus 10, according to the preferred embodiment of the present invention, is disclosed. The apparatus 10 depicted as utilized for a progressive installation of a pool wall 60. The pool wall 60 comprises a partially deployed portion 62, a coiled portion 61, a plurality of wall uprights 63 and a wall channel 64. A first user 71 secures the pool wall 60 onto a wall upright 63 and insures that the bottom edge is situated within a wall channel 64. A first hand 73 of a second user 72 steadies an assembly 70, comprising the apparatus 10 and the coiled portion 61, while a second hand 74 pulls the assembly 70 by a bi-furcated rope 19 permanently attached onto a base 11 and comprising a handle 21. The bi-furcated rope allows the second user 72 to pull the assembly 70 along a perimeter outlining a configuration of a pool upon a ground 66, thereby causing an induced rotation of the turntable 16 and the coiled portion 61 to progressively deploy the wall 60.

Referring now to FIG. 2*a*, a perspective assembled view of the apparatus 10, according to the preferred embodiment of the present invention, is disclosed. The apparatus 10 comprises the base 11, envisioned to be similar to a regular circular sled, a platform 14, a platform supporting filler 13, and a turntable 16 comprising an integral tubular center post 17 wherein a top portion comprises a hub 18 intended to center and stabilize the coiled portion 61 of the pool wall 60 material. A bearing 12 is envisioned to comprise a plurality of stacked flat disks made of a low friction plastic; such as, but not limited to: TEFLON® or NYLON®, wherein a friction is progressively reduced by a rotational interaction between corresponding disk surface portions.

Referring now to FIG. 2*b*, a perspective exploded view of the apparatus 10, according to the preferred embodiment of the present invention, is disclosed. The apparatus 10 comprises the base 11, an axle 22, and the platform 14 comprising a pair of ears 23. The platform 14 is supported within the base 11 by the filler 13 and non-rotationally fixed by engaging a pair of ears 23 into a pair of corresponding slots 24 comprised within the rim of the base 11. The axle 22, envisioned to be fastened onto the inside bottom portion of the base 11 either removably by threaded fasteners, or permanently by rivets, welding or chemical bonding, maintains the centered location of the filler 13, the platform 14 and the bearing 12 by means of the apertures 15*a*, 15*b*, and 15*c*. The assembly of the turntable 16 and the integral center post 17 is rotationally installed onto the axle 22.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by a pair of common users in a simple and effortless manner with little or no training. After initial purchase or acquisition of the various components of the apparatus 10, it would be assembled as indicated in FIG. 2A and operated as indicate in FIG. 1.

The method of assembling and utilizing the apparatus 10 may be achieved by performing the following steps: inspecting all components; installing the filler 13 over the axle 22; ensuring the seating of the filler 13 into the base 11; installing the platform 14 over the axle 22 and onto the filler 13; ensuring the seating of the pair of ears 23 within the slots 24 of the base 11; installing the plurality of disks comprising the bearing 12 over the axle 22 and onto the platform 14; installing the assembly comprising the turntable 16, the center post 17 and the hub 18 over the axle 22 and onto the bearing 12; checking the freedom of rotation of the assembly 16, 17, 18; tilting the apparatus 10 to facilitate the installation of the coiled material 61 over the center post 17 and the hub 18; up-righting the apparatus 10; grasping the handle 21 of the bifurcated rope 19; moving the apparatus 10 to a starting location of the pool wall perimeter; inserting a lower edge of a starter portion of the coiled portion 61 hereinto the wall channel 64; fastening the loose edge of the coiled portion 61 onto a first wall upright 63; de-reeling the coiled portion progressively by continuously pulling the apparatus 10 by the bi-furcated rope 19 along the pre-determined perimeter of the pool; fastening each deployed portion 62 onto each wall upright 63 in conjunction with the progress of the deployment of the pool wall 60; closing the pool wall 60 loop by fastening the remaining tail end of the coiled portion 61 onto the last wall upright 63 and the starter portion; removing the apparatus 10 from the pool location; and disassembling, cleaning and storing the apparatus 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An above-ground pool wall installation apparatus for unwinding and installing a pool wall, said above-ground pool wall installation apparatus comprising:

a dome-shaped base adapted to be positioned on a ground, said base having an axle fixedly mated onto an inside bottom portion of said base;

a platform seated on said base, said platform comprising a pair of ears located at axially opposed edges thereof;

a bearing positioned on said platform; and, a turntable seated on said bearing and rotatably positioned about said axle;

wherein said turntable is adapted to receive and selectively unwind a coiled portion of the pool wall as said base is displaced along the ground.

2. The above-ground pool wall installation apparatus of claim 1, wherein said bearing comprises: a plurality of stacked flat disks; wherein said bearing has a friction coefficient that is progressively reduced by the rotational interaction between corresponding disk surfaces of said stacked flat disks.

3. The above-ground pool wall installation apparatus of claim 1, wherein said base comprises:

a plurality of slots located at axially oppose rim portions of said base;

a platform supporting filler located within said base; and, a bi-furcated rope attached to said base and having a handle attached thereto;

wherein said platform is supported on said filler; and, wherein said platform is non-rotationally fixed by engagement of said ears of said platform into said slots of said base respectively.

4. The above-ground pool wall installation apparatus of claim 3, wherein said turntable comprises:

an integral tubular center post; and, a hub located on a top portion of said center post;

wherein said platform is adapted to center and stabilize a coiled portion of said pool wall.

5. The above-ground pool wall installation apparatus of claim 4, wherein each of said filler, said bearing and said platform is provided with a separate central aperture respectively;

wherein said axle maintains a centered location of said filler, said platform and said bearing by passing through each of said respective apertures of said filler, said platform and said bearing respectively; and, wherein said turntable and said integral center post are rotationally installed onto said axle.

6. An above-ground pool wall installation apparatus for unwinding and installing a pool wall, said above-ground pool wall installation apparatus comprising:

a dome-shaped base adapted to be positioned on a ground, said base having an axle fixedly mated onto an inside bottom portion of said base;

a platform seated on said base, said platform comprising a pair of ears located at axially opposed edges thereof;

a bearing positioned on said platform; and, a turntable seated on said bearing and rotatably positioned about said axle;

wherein said turntable is adapted to receive and selectively unwind a coiled portion of the pool wall as said base is displaced along the ground.

7. The above-ground pool wall installation apparatus of claim 6, wherein said bearing comprises: a plurality of stacked flat disks; wherein said bearing has a friction coefficient that is progressively reduced by the rotational interaction between corresponding disk surfaces of said stacked flat disks.

8. The above-ground pool wall installation apparatus of claim 7, wherein said base comprises:

a plurality of slots located at axially oppose rim portions of said base;

a platform supporting filler located within said base; and, a bi-furcated rope attached to said base and having a handle attached thereto;

wherein said platform is supported on said filler; and, wherein said platform is non-rotationally fixed by engagement of said ears of said platform into said slots of said base respectively.

9. The above-ground pool wall installation apparatus of claim 8, wherein said turntable comprises:

an integral tubular center post; and, a hub located on a top portion of said center post;

wherein said platform is adapted to center and stabilize a coiled portion of said pool wall.

10. The above-ground pool wall installation apparatus of claim 9, wherein each of said filler, said bearing and said platform is provided with a separate central aperture respectively;

wherein said axle maintains a centered location of said filler, said platform and said bearing by passing through each of said respective apertures of said filler, said platform and said bearing respectively; and, wherein said turntable and said integral center post are rotationally installed onto said axle.

11. A method of utilizing an above-ground pool wall installation apparatus for unwinding and installing a pool wall, said method comprising the steps of:

providing and positioning a dome-shaped base on a ground;

providing and fixedly mating an axle onto an inside bottom portion of said base;

providing and seating a platform on said base, said platform comprising a pair of ears located at axially opposed edges thereof;

providing and positioning a bearing on said platform;

providing and seating a turntable on said bearing;

rotatably positioning said turntable about said axle;

positioning a coiled portion of the pool wall about said turntable; and, causing said turntable to selectively unwind the coiled portion of the pool wall by displacing said base along the ground.

* * * * *